US009310029B2

(12) United States Patent
Kim

(10) Patent No.: US 9,310,029 B2
(45) Date of Patent: Apr. 12, 2016

(54) METHOD FOR ILLUMINATING SPACE

(71) Applicant: KMW INC., Hwaseong, Gyeonggi-Do (KR)

(72) Inventor: Duk Yong Kim, Gyeonggi-Do (KR)

(73) Assignee: KMW Inc., Hwaseong, Gyeonggi-do (KR)

( * ) Notice: Subject to any disclaimer, the term of this patent is extended or adjusted under 35 U.S.C. 154(b) by 3 days.

(21) Appl. No.: 14/312,445

(22) Filed: Jun. 23, 2014

(65) Prior Publication Data

US 2014/0301077 A1 Oct. 9, 2014

Related U.S. Application Data

(63) Continuation of application No. PCT/KR2012/011292, filed on Dec. 21, 2012.

(30) Foreign Application Priority Data

Dec. 23, 2011 (KR) ..... 10-2011-0141544

(51) Int. Cl.

| | |
|---|---|
| ***F21K 99/00*** | (2010.01) |
| ***F21S 2/00*** | (2006.01) |
| ***F21V 7/00*** | (2006.01) |
| ***H05B 33/00*** | (2006.01) |
| *F21Y 101/02* | (2006.01) |
| *F21Y 105/00* | (2006.01) |

(52) U.S. Cl.

CPC ... *F21K 9/10* (2013.01); *F21K 9/00* (2013.01); *F21S 2/00* (2013.01); *F21V 7/00* (2013.01); *F21V 7/0058* (2013.01); *H05B 33/00* (2013.01); *F21Y 2101/02* (2013.01); *F21Y 2105/001* (2013.01)

(58) Field of Classification Search

None

See application file for complete search history.

(56) References Cited

U.S. PATENT DOCUMENTS

2009/0237924 A1 9/2009 Ladewig

FOREIGN PATENT DOCUMENTS

| | | | | |
|---|---|---|---|---|
| CN | 201416845 | Y | 3/2010 | |
| JP | 8180705 | A | 7/1996 | |
| JP | 9259611 | A | 10/1997 | |
| JP | 10-255521 | A | 9/1998 | |
| JP | 2004-241287 | A | 8/2004 | |
| JP | 2009-277355 | A | 11/2009 | |
| JP | 2010-073627 | A | 4/2010 | |
| KR | 10-0920019 | B1 | 10/2009 | |
| KR | 2010-0007093 | A | 1/2010 | |
| KR | 2010-0054355 | A | 5/2010 | |
| KR | 2010-0077355 | A | 7/2010 | |
| KR | 10-1052457 | B1 | 7/2011 | |
| KR | 2011-0122938 | A | 11/2011 | |
| KR | 101377144 | B1 * | 3/2014 | ..... F21S 8/086 |
| WO | WO-2009/028090 | A1 | 3/2009 | |

* cited by examiner

*Primary Examiner* — Mary Ellen Bowman

(74) *Attorney, Agent, or Firm* — Mintz Levin Cohn Ferris Glovsky and Popeo, P.C.; Kongsik Kim; Colleen H. Witherell

(57) ABSTRACT

The present invention relates to a method for illuminating a space, and more specifically, to a method for illuminating a space using a plurality of LED illumination modules, wherein the plurality of LED illumination modules adjust a mutual distribution ratio between a vertical illuminance and a horizontal illuminance, which is greater than the vertical illumination, according to a limitation of a radiation angle at one point within the space having the constant volume. The present invention can increase the efficiency of illumination and can reduce electric energy by lowering the vertical illuminance compared to the horizontal illuminance.

9 Claims, 5 Drawing Sheets

METHOD FOR ILLUMINATING SPACE

CROSS-REFERENCE TO RELATED APPLICATIONS

This is a continuation of International Application No. PCT/KR2012/011292 filed on Dec. 21, 2012, which claims priority to Korean Application No. 10-2011-0141544 filed on Dec. 23, 2011, which applications are incorporated herein by reference.

TECHNICAL FIELD

The present invention relates to a method for illuminating a space, and more particularly, to a method for illuminating a space capable of increasing energy efficiency when an interior space such as an office and so on is illuminated.

BACKGROUND ART

Generally, an illumination of an interior space such as an office and so on uses a plurality of fluorescent lights installed on a ceiling. The fluorescent light as a light source is comparatively cheap, but a life time thereof is comparatively short, and the longer a period of use is, the lower a brightness thereof is.

In addition, a radiation angle, which is a radiated angle of a light, of the fluorescent light is equal to or larger than 120 degrees, and the fluorescent light illuminates the whole of the interior space in a regular illuminance.

In order to solve problems of the fluorescent light as the light source having the above-mentioned problems such as the comparatively short life time and the decrease of the brightness according to the use thereof, technologies for using an LED, of which a life time is very long and a power consumption is low, as an interior illuminating device have been developing.

For example, in Registered Patent No. 10-1052457, a lamp using the LED as the light source illuminates the interior space by widening the radiation angle of a light radiated from the LED to an angle equal to or larger than 120 degrees by using a diffusion plate or a lens.

However, the above-mentioned conventional method for illuminating a space cannot obtain an effect of decreasing energy largely, although the conventional method for illuminating a space uses the LED of which efficiency is high. Thus, an LED plane light-emitting device for replacing the conventional fluorescent light is suggested, in which the LED plane light-emitting device illuminates a corresponding interior space entirely, but a relationship between a horizontal illuminance and a vertical illuminance is not considered in the LED plane light-emitting device.

Hereinafter, the conventional method for illuminating a space is described in more detail with reference to accompanying drawing.

FIG. 1 is an illustration for describing the conventional method for illuminating a space.

Referring to FIG. 1, the conventional method for illuminating a space sets the vertical illuminance and the horizontal illuminance similarly by using a plurality of adjacent illuminations L1 and L2 of which radiation angles are equal to or larger than 100 degrees.

That is, the whole of the interior space is illuminated by setting an illuminance of a horizontal surface of an object and an illuminance of a vertical surface of the object to be almost equal in a specific position.

In FIG. 1, for convenience of description, light progression paths A1 to A4 and B1 to B4 of each of the illuminations L1 and L2 within the radiation angle are shown. All of the illuminations L1 and L2 are equally positioned at a height of h from a bottom surface.

At this time, in illuminance measuring points P1 and P4 in a vertical direction from each of the illuminations L1 and L2, since the light progression paths A1 and B1 are shortest, an illuminance is the highest when a single illumination is installed, but on the contrary, the nearer to an edge of the radiation angle, the lower an illuminance of the bottom surface is.

This is because the illuminance is inversely proportional to a square of a distance from the light source.

At this time, in an illuminance measuring point P1 in the vertical direction, the light progression path A1 of the illumination L1 and the light progression path B4 of another illumination L2 overlap, and thus the illuminance of the illuminance measuring point P1 of a corresponding position is determined by an amount of the light emitted from two illuminations L1 and L2.

In addition, the illumination measuring point P2 is a position where the light progression path A2 of the illumination L1 and the light progression path B3 of the illumination L2 overlap, and the illuminance is determined according to the distances from the two illuminations L1 and L2.

The progression paths affecting the two illuminance measuring points P1 and P2 are A1 and B4, and A2 and B3, respectively, and at this time the light amount has A1>A2>B3>B4 relation, thus the illuminances of two illuminance measuring points P1 and P2 are substantially equal.

This may be equally applied to all illuminance measuring points P1, P2, P3 and P4.

As described above, the whole space illuminated by the two adjacent illuminations L1 and L2 has a regular illuminance due to the effect of the two adjacent illuminations L1 and L2.

In addition, in FIG. 1, when a random illuminance measuring point P between the two illuminations L1 and L2 is considered, the radiation angles of the lights radiated from each of the illuminations L1 and L2 is wide, and thus the vertical illuminance which is the illuminance of the vertical surface of the random illuminance measuring point P and the horizontal illuminance which is the illuminance of the horizontal surface of the random illuminance measuring point P are almost equal.

Thus, a whole of an upper side and a lower side of the space is seen brightly. At this time, when the upper side of the space should be dark and a work space (i.e. the lower side of the space) should be bright, in order to achieve this, an additional auxiliary illumination should be furnished.

SUMMARY

The technical subject to be resolved by the present invention considering the above-mentioned problems is to provide a method for illuminating a space capable of controlling a vertical illuminance.

A method for illuminating a space of the present invention for resolving the above-mentioned problems is a method for illuminating a space, using a plurality of LED illuminating modules, and the plurality of LED illumination modules control a distribution ratio between a vertical illuminance and a horizontal illuminance at one point within the space having a constant volume, according to a light distribution condition.

A method for illuminating a space of the present invention may properly control a distribution ratio between a horizontal illuminance and a vertical illuminance, that is, the method may distribute the horizontal illuminance and the vertical illuminance according to a use of an interior space, and thus there is an effect of decreasing electric energy by increasing an efficiency of an illumination.

In addition, the present invention may properly control a distribution ratio between a horizontal illuminance and a vertical illuminance, for example, may increase the horizontal illuminance more than the vertical illuminance in a case of an interior space such as a normal office or a library and may increase the vertical illuminance more than the horizontal illuminance in a case of a hallway of a hotel or a goods display space in a side of a market and so on to properly control distribution ratio according to a use of a corresponding space, and thus there is an effect of improving a concentration due to an illumination.

DESCRIPTION OF REFERENCE NUMERALS

1 and 10: LED
2 and 20: substrate
3 and 30: reflector

DETAILED DESCRIPTION

Hereinafter, a method for illuminating a space according to a preferable exemplary embodiment of the present invention is described in detail with reference to accompanying drawings.

In the present exemplary embodiment, as a method for illuminating a space, controlling a ratio between a whole of a horizontal illuminance and a vertical illuminance within a space, by controlling a light distribution condition of an LED illuminating module, in a space where a plurality of LED illuminating modules are disposed, is described.

Hereinafter, first, limiting a radiation angle of each of illuminating modules is described.

Figure 2:
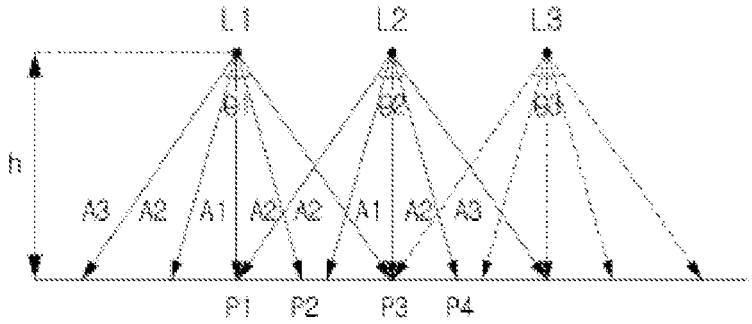
FIG. 2 is a description view for describing a method for illuminating a space according to the present invention.

FIG. 2 is a description view for describing the method for illuminating a space according to a preferable exemplary embodiment of the present invention. In FIG. 2, it is described that a vertical illuminance decreases and a horizontal illuminance increases within the space, as an example.

Referring to FIG. 2, the method for illuminating a space according to the preferable exemplary embodiment limits radiation angles θ1 and θ2 of first and second illuminations L1 and L2 in order to decrease the vertical illuminance illuminated by the first and second illuminations L1 and L2 adjacent from each other and increase a horizontal illuminance.

Here, θ1 and θ2 are the radiation angles of the first and second illuminations L1 and L2.

Figure 1:
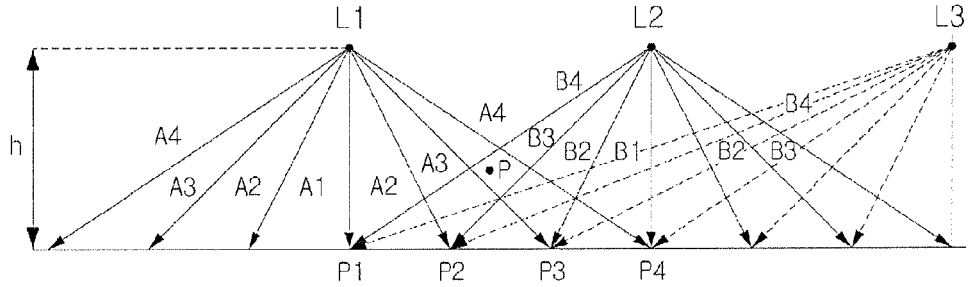
FIG. 1 RELATED ART
FIG. 1 is a description view for describing a conventional method for illuminating a space.

When the first illumination L1 is used alone after decreasing the radiation angles θ1 and θ2 compared to radiation angles of first and second illuminations of a conventional FIG. 1, an illuminance of a illuminance measuring point P3 located in an outermost area of a light radiating paths A1 to A3 is higher than an illuminance of an area A4 of an outermost area in a method for illuminating a space shown in the conventional FIG. 1.

This is because a distance from the first light source L1 decreases by decreasing the radiation angle θ1, and because a light amount of the first light L1 is concentrated in a horizontal side rather than the light amount of the first light L1 being not distributed in a vertical side, by concentrating a whole of a light amount of the light source.

Thus, the lower the radiation angle θ1 of the first light L1 is, the lower the vertical illuminance is and the higher the horizontal illuminance is.

As described above, by decreasing the vertical illuminance and increasing the horizontal illuminance, the first and second illuminations L1 and L2 may obtain the horizontal illuminance equal to the conventional horizontal illuminance in a power lower than the conventional power, and thus energy may further be decreased.

In the present exemplary embodiment, decreasing the vertical illuminance and increasing the horizontal illuminance are described as an example, but it not limited thereto.

As described above, the ratio between the vertical illuminance and the horizontal illuminance may be determined by the limitation of the light radiation angles θ1 and θ2 of the first and second illuminations L1 and L2. That is, the lower the light radiation angles θ1 and θ2 are, the lower the vertical illuminance is, and on the contrary, the higher the horizontal illuminance is.

Here, increasing the horizontal illuminance means increasing a horizontal average illuminance of an interior space.

It is preferable that the first and second illuminations L1 and L2 are LED illuminating modules wherein a light source is an LED, each of the light radiation angles θ1 and θ2 of each of the LED light modules is 10 to 90 degrees, and the ratio between the vertical illuminance and the horizontal illuminance of the interior space is 2:8 to 4:6.

When each of the light radiation angles θ1 and θ2 is smaller than 10 degrees, an area illuminated is too small, and when each of the light radiation angles θ1 and θ2 is equal to or larger than 90 degrees, a decreasing effect of the vertical illuminance is degraded, and thus an energy decreasing effect is not large.

As described above, when the vertical illuminance decreases by limiting the radiation angle while using the illumination equal to the conventional illumination, a work space such as a desk and so on is more brightened due to the increase of the horizontal illuminance, however a vertically installed structure such as a wall or a partition in the interior space is dimly seen.

However, the illuminance of the horizontal surface where a work is substantially performed increases compared to the conventional horizontal illuminance, and this may generate an effect similarly to installing a stand illumination in only the work space while turning off an interior illumination, and may enable a worker to improve concentration on the work.

Specially, in a case of a monitor, usually, the monitor is positioned vertically to a ceiling surface where the illumination is installed, and thus the vertical illuminance of the illumination has an effect on a person while the person works by viewing the monitor. Thus, when the vertical illuminance of the illumination is lowered, the illumination light input to the monitor or reflected from the monitor decreases, and thus a monitor screen may be further clearly seen. That is, the present invention may enable the monitor screen to be clearly displayed, by decreasing a light amount concerned to the vertical illuminance input to the vertically installed monitor screen.

Table 1 below shows a result of a simulation wherein an illumination of which a power of an LED is about 460 W is installed in a dark room of which a horizontal length is 10 cm, a vertical length is 10 cm and a height is 3 m, and radiation angles are limited as 60 degrees and 30 degrees respectively.

A measurement of the horizontal illuminance is performed in a height of 0.85 m, which is a height of a work space, from a bottom surface, and a measurement of the vertical illuminance is performed in a height of 1 m, which is about a height where the monitor is installed, from the bottom surface.

TABLE 1

| Radiation angle | Vertical illuminance (% change) | Horizontal illuminance (% change) | LED power |
|---|---|---|---|
| 60 degrees | 30.1 | 69.9 | 480 W |
| 30 degrees | 22.0 | 78 | 480 W |

In a state wherein the radiation angle is 60 degrees, the ratio between an average value of the vertical illuminance and an average value of the horizontal illuminance is about 30:70, and in a state wherein the radiation angle is 30 degrees, the ratio between the average value of the vertical illuminance and the average value of the horizontal illuminance is 22:78.

That is, the lower the radiation angle is, the lower the vertical illuminance is, and thus the horizontal illuminance increases.

Figure 3:
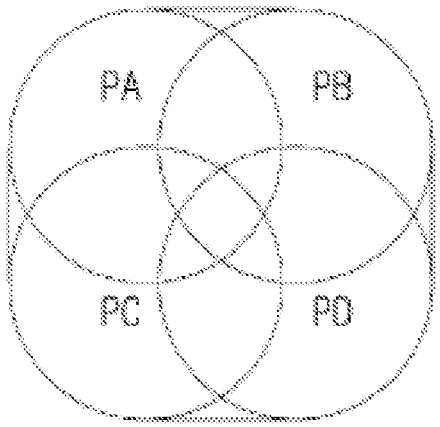
FIG. 3 is a description view illustrating a light distribution pattern of a method for illuminating a space according to another exemplary embodiment of the present invention.

FIG. 3 is a description view illustrating a light distribution pattern of a method for illuminating a space according to another exemplary embodiment of the present invention.

Referring to FIG. 3, in the present invention, the light radiation angle of one LED illuminating module is within the above-mentioned 10 to 90 degrees, the light radiated from the LED illuminating module has a light distribution pattern LP near to a circle shape in the vertical surface.

At this time, the light distribution pattern LP includes divided areas PA, PB, PC and PD.

As described above, when the light distribution pattern LP includes a plurality of areas, an illuminance difference between a central area and an edge area of the light pattern may be improved, and a generation of a dark shadow due to a concentration of the light may be prevented.

In addition, in the illumination using the same light radiation angle, when one light distribution pattern LP is divided into the plurality of areas PA, PB, PC and PD, the ratio between the vertical illuminance and the horizontal illuminance is slightly changed.

Table 2 below shows a result of a simulation wherein a condition is identical to the condition of an experiment of the table 1, and one light distribution pattern is divided into 4 areas.

TABLE 2

| Radiation angle | Vertical illuminance (% change) | Horizontal illuminance (% change) | LED power |
|---|---|---|---|
| 60 degrees | 28 | 72 | 480 W |
| 30 degrees | 20 | 80 | 480 W |

As described above, the present invention may control the ratio between the vertical illuminance and the horizontal illuminance by the control of the radiation of the LED illuminating module and the division of the light distribution pattern of the LED illuminating module, which are the light distribution condition, and thus an effect of decreasing the energy may increase by extremely lowering the vertical illuminance as necessary.

Figure 4:
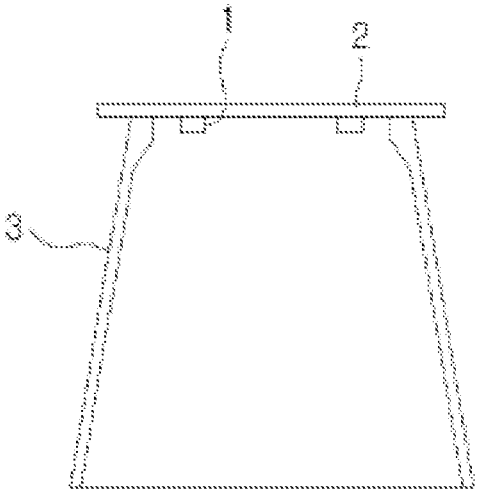
FIGS. 4 and 5 are configuration views illustrating an LED illuminating module for forming the light distribution pattern in FIG. 3.

FIG. 4 is an exemplary embodiment configuration view illustrating an LED illuminating module dividing the light distribution pattern into the plurality of areas as shown in FIG. 3.

Referring to FIG. 4, the LED illuminating module applied to the present invention may include a substrate 2 on which a plurality of LED chips 1 are mounted in positions spaced apart from each other, and a reflector 3 limiting the radiation angle of the light radiated from the plurality of LED chips 1 to 10 to 90 degrees and dividing one light distribution pattern into a plurality of areas by dividing the light of each of the LED chips 1.

The reflector 3 may have a reflection surface inside the reflector 3 in order to form the divided plurality of areas PA, PB, PC and PD, but although such a reflection surface is not formed, it is possible to radiate the light to the divided areas by controlling a disposition interval of the LED chips 1.

Figure 5:
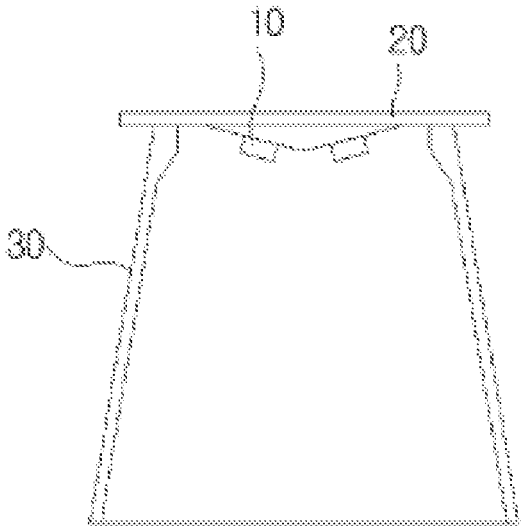

FIG. 5 is another exemplary cross-sectional configuration view illustrating an LED illuminating module to which the present invention is applied.

Referring to FIG. 5, the LED illuminating module to which the present invention is applied may include LED chips 10 slantly disposed on a substrate 20 in different directions, and a reflector 30 limiting each of the radiation angles of the LED chips 10 to a range of 10 to 90 degrees.

The above-mentioned configuration may form the light distribution pattern LP including the divided areas PA, PB, PC and PD, by forming a direction angle difference of a light radiating surface in the LED chips 10 while limiting the light radiation angles of the whole of the LED chips 10 to 10 to 90 degrees by using the reflector 30 having a midair of cup shape.

In addition, although not shown in drawings, the light distribution pattern including the divided areas may be formed by using an additional dividing means, for example, an optical means such as a lens etc.

In the present exemplary embodiment, the radiation angle of the LED illuminating module, and an area division of the light distribution pattern are described, as an example, by using a proper control of a sharing ratio between the horizontal illuminance and the vertical illuminance of the illumination within the space having a constant volume, but is not limited thereto. That is, it may be changed to one condition or multiple appliances among various conditions such as a distance between the LED illuminating modules disposed within the space, a brightness of the illuminating module, a distance between the illuminating module and a work surface, etc.

The present invention is not limited to the above-mentioned exemplary embodiment, and it is obvious that the present invention is capable of further changes and modifications variably in a scope without departing from a technical point of the present invention by a person having ordinary skills in a technical field to which the invention pertains.

The invention claimed is:

1. A method for illuminating a space, the method using a plurality of LED illumination modules, wherein the plurality of LED illumination modules control a mutual distribution ratio between a vertical illuminance and a horizontal illuminance and provides different vertical illuminance and horizontal illuminance at one point within the space having a constant volume, according to a light distribution condition.

2. The method as claimed in claim 1, wherein the light distribution condition is a control of a radiation angle, or the control of the radiation angle and a division of a light distribution pattern.

3. The method as claimed in claim 2, wherein the radiation angle is 10 to 90 degrees, and the light distribution pattern is divided into at least two areas.

4. The method as claimed in claim 2, wherein the LED illuminating module includes a plurality of LED chips installed on a substrate, and a reflector for limiting a light radiation angle of the LED chip to 10 to 90 degrees, and the LED chips are spaced apart from each other so that the LED chips radiate to at least two areas.

5. The method as claimed in claim 4, wherein the reflector encloses a whole of the plurality of LED chips and is arranged in a midair of cup shape, and an inner surface of the reflector includes a reflection surface which guides the LED chips so that the LED chips radiate to the at least two areas different from each other.

6. The method as claimed in claim 5, wherein each of the LED illuminating modules includes the plurality of LED chips installed on the substrate, and each of the LED chips is disposed so that each of the LED chips has a different radiation angle to radiate a divided light.

7. The method as claimed in claim 1, wherein the ratio between the vertical illuminance and the horizontal illuminance is 2:8 to 4:6.

8. The method as claimed in claim 1, wherein the light distribution condition of the LED illuminating module is a control of a radiation angle, and the radiation angle is 10 to 90 degrees.

9. The method as claimed in claim 2, wherein the radiation angles of the plurality of LED illuminating modules are different from each other.

* * * * *